US006393244B1

(12) United States Patent
Nakayasu et al.

(10) Patent No.: US 6,393,244 B1
(45) Date of Patent: May 21, 2002

(54) COLOR SHIFT CORRECTING STRUCTURE OF IMAGE FORMING APPARATUS

(75) Inventors: Hirofumi Nakayasu; Susumu Imado, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/617,822

(22) Filed: Jul. 17, 2000

(30) Foreign Application Priority Data

Sep. 17, 1999 (JP) ..... 11-262873

(51) Int. Cl.[7] ..... G03G 15/14

(52) U.S. Cl. ..... 399/301; 399/299; 399/30; 399/306

(58) Field of Search ..... 399/30, 162, 163, 399/167, 298, 299, 300, 301, 306

(56) References Cited

U.S. PATENT DOCUMENTS 5,875,380 A 2/1999 Iwata et al. ..... 399/301

FOREIGN PATENT DOCUMENTS

| | | |
|---|---|---|
| EP | 0 816 930 | 1/1998 |
| EP | 0 866 603 | 9/1998 |
| JP | 5-197244 | 8/1993 |
| JP | 6-144631 | 5/1994 |
| JP | 8-211693 | 8/1996 |
| JP | 9-62047 | 3/1997 |

OTHER PUBLICATIONS

Copy of European Patent Office communication for corresponding European Patent Application 00115371 including European Search Report dated Feb. 14, 2001.

*Primary Examiner*—Sophia S. Chen
*Assistant Examiner*—Hoang Ngo
(74) *Attorney, Agent, or Firm*—Armstrong, Westerman & Hattori, LLP

(57) ABSTRACT

An image-forming device such as a full color printer is provided which is designed to correct the speed of an image carrier such as a sheet conveyer belt for compensating for a shift between colors. The image-forming device forms electrostatic marks on the image carrier at regular intervals and detects the marks using a sensor(s) to determine a change in speed of the image carrier based on sensor signals.

12 Claims, 10 Drawing Sheets

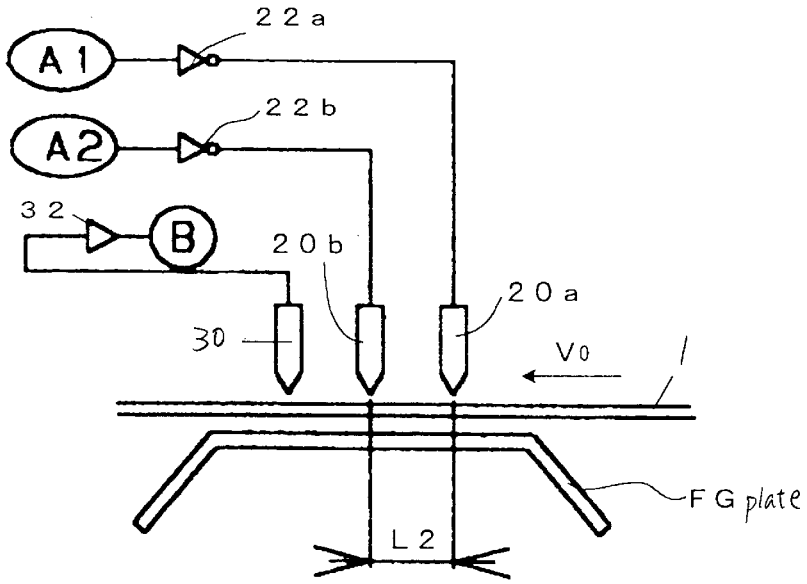
FIG. 9
FIG. 10(a)
FIG. 10(b)
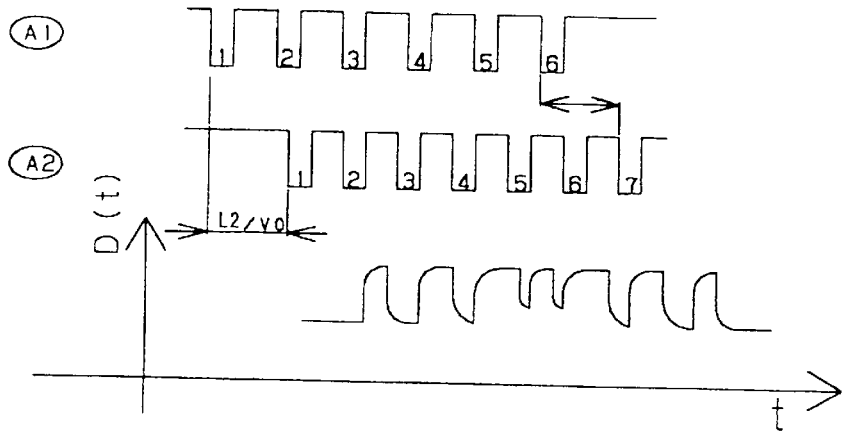

COLOR SHIFT CORRECTING STRUCTURE OF IMAGE FORMING APPARATUS

BACKGROUND OF THE INVENTION

1 Technical Field of the Invention

The present invention relates generally to an image-forming apparatus which is designed to convert an image carried by an image carrier into a visual image and transfer it onto a print sheet and which may be employed in copying machines, facsimile machines, printers, or information processing systems using electrophotographic printing techniques, and more particularly to an improved color shift correcting structure of such an image-forming apparatus.

2 Background Art

Typical color image-forming apparatuses are designed to form a multi-colored image by overlaying yellow, magenta, cyan, and block images in registration on a print sheet. A positional shift between the different color images on the print sheet will, thus, result in a shift between colors. In order to eliminate such a color shift, Japanese Patent No. 2505206 teaches printing marks continuously on a transfer belt for correcting a shift between color images. This structure is designed to correct locations of images formed by exposure of photosensitive drums on which the marks are to be printed and not the speed of the transfer belt. The distances from a sensor detecting the marks to each photosensitive drum and an image-transferred location of the transfer belt are long. A change in speed of the transfer belt in a long cycle (e.g., 1 m or more) may thus be corrected, but it is difficult to correct one in a short cycle (e.g., several tens mm).

The marks are first formed on the photosensitive drums and then transferred to the transfer belt. It is, thus, difficult to determine whether a positional shift of the marks arises from a change in speed of the transfer belt or a change in speed of the photosensitive drum, thereby resulting in a difficulty in correcting the speed of the transfer belt using the marks.

Japanese Patent First Publication Nos. 8-211693, 6-144631, and 9-62047 teach a belt speed correction structure in which two sensor are arrayed in lengthwise direction of a transfer belt to measure the time required for one of marks printed on the transfer belt to pass the two sensors for calculating the speed of the transfer belt.

The structure as taught in Japanese Patent First Publication No. 8-211693 prints a plurality of magnetic marks along the periphery of the transfer belt. Therefore, if the belt is partly deformed due to, for example, residual stress of the belt created during manufacture, it will result in a change in pitch of the marks, which makes it difficult to measure the speed of the belt accurately.

The structures as taught in Japanese Patent First Publication Nos. 6-144631 and 9-62047 print a plurality of marks with toner. The surface of a transfer belt is usually cleaned by a cleaner blade. A problem is, thus, encountered in that the marks may erased by friction between themselves and a cleaner blade. An additional problem is also encountered in that a consumption of toner is increased.

Typical color image-forming apparatus also have a sheet conveyer belt for transporting a print sheet to which images are to be transferred from a transfer belt. The sheet conveyer belt is usually moved by a drive roller. The drive roller is increased in temperature by radiation of heat from a neighboring fixer, leading to thermal expansion, which will result in a change in diameter of the drive roller. This change will cause the speed of the sheet conveyer belt to be changed, resulting in a shift between color images.

SUMMARY OF THE INVENTION

It is therefore a principal object of the present invention to avoid the disadvantages of the prior art.

It is another object of the present invention to provide an image-forming apparatus designed to measure the speed of image carriers such as photosensitive drums, a transfer belt, and a sheet conveyer belt accurately and eliminate positional shifts between colored images for avoiding a shift between colors.

According to one aspect of the invention, there is provided an image-forming apparatus which comprises: (a) an image carrier carrying images printed on one of a surface of the image carrier and a surface of a printing medium held on the image carrier, the image carrier having at least the surface made of a dielectric material; (b) an electrostatic mark writing device writing electrostatic marks at predetermined intervals on the image carrier during movement of the image carrier; (c) a detecting device detecting the electrostatic marks written on the image carrier during the movement of the image carrier to provide signals indicative thereof; and (d) a correction device correcting a speed of the movement of the image carrier based on the signals outputted from the detecting device.

In the preferred mode of the invention, the electrostatic mark writing device includes a plurality of electrostatic mark writing units which are arrayed in a direction of the movement of the image carrier and which form the electrostatic marks on the image carrier, respectively.

Each of the electrostatic mark writing units writes a series of the electrostatic marks at regular intervals. The intervals in the electrostatic mark writing units are different from each other. The correcting device performs a correcting operation based on the degree to which the electrostatic marks written by the electrostatic mark writing units are overlaid.

The detecting device may alternatively include a plurality of detecting units which are arrayed in a direction of the movement of the image carrier and which detect the electrostatic images, respectively.

According to another aspect of the invention, there is provided an image-forming apparatus which comprises: (a) an image carrier carrying images printed on one of a surface of the image carrier and a surface of a printing medium held on the image carrier, the image carrier having at least the surface made of a dielectric material; (b) an electrostatic mark writing device writing electrostatic marks at predetermined intervals on the image carrier during movement of the image carrier; (c) a detecting device detecting the electrostatic marks written on the image carrier during the movement of the image carrier to provide signals indicative thereof; and (d) a correction device correcting a location where each of the images is printed based on the signals outputted from the detecting device.

In the preferred mode of the invention, the electrostatic mark writing device includes a plurality of electrostatic mark writing units which are arrayed in a direction of the movement of the image carrier and which print the electrostatic marks on the image carrier, respectively.

Each of the electrostatic mark writing units writes a series of the electrostatic marks at regular intervals. The intervals in the electrostatic mark writing units are different from each other. The correcting device performs a correcting operation based on the degree to which the electrostatic marks written by the electrostatic mark writing units are overlaid.

The detecting device may alternatively include a plurality of detecting units which are arrayed in a direction of the movement of the image carrier and which detect the electrostatic images, respectively.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 9 is a side view which shows a detecting device and a mark writing device installed above a conveyer belt according to the third embodiment of the invention;

FIG. 10(*a*) shows pulse trains applied to electrodes of a mark writing device;

FIG. 10(*b*) shows a current signal outputted from an electrode of a detecting device;

FIG. 14(*b*) shows a locational shift data;

FIG. 14(*c*) shows a correction data; and

FIG. 14(*d*) shows a result of printing.

DESCRIPTION OF THE PREFERRED EMBODIMENTS

Figure 1:
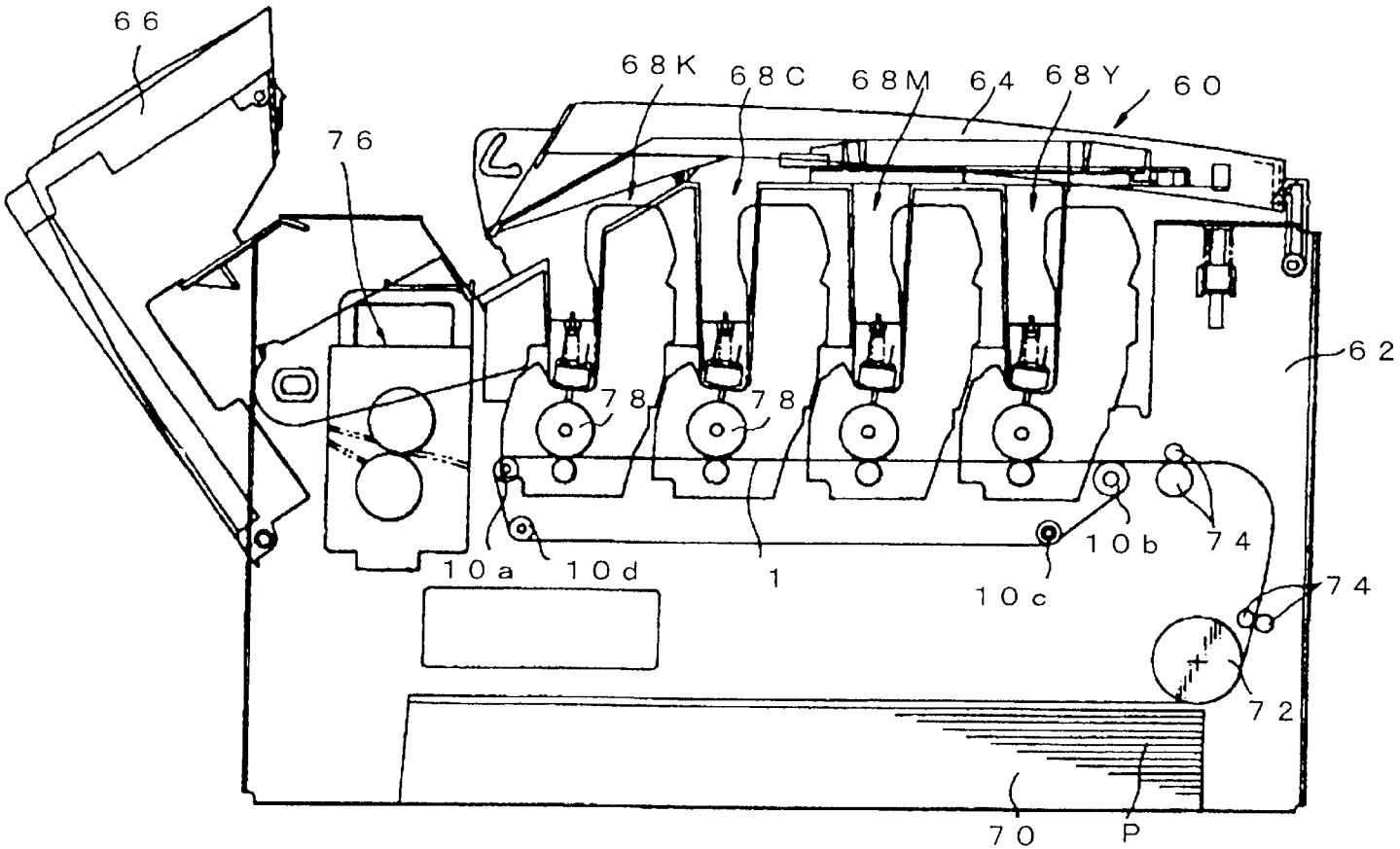
FIG. 1 is a cross sectional view which shows an image-forming device according to the first embodiment of the invention.

Referring now to the drawings, wherein like numbers refer to like parts in several views, particularly to FIG. 1, there is shown an image-forming device 60 according to the invention which will be discussed below as a full color printer.

The image-forming device 60 has four print assemblies 68Y, 68M, 68C, and 68K arranged in line and an endless conveyer belt 1 traveling through the print assemblies 68Y to 68K. The conveyer belt 1 is made of a synthetic resin material such as fluorine-contained polymers (e.g., Polyvinylidene Fluoriden) which has high durability and ability to hold a print sheet P statically. The conveyer belt 1 is wound around four rollers 10*a*, 10*b*, 10*c*, and 10*d*. The roller 10*a* is a drive roller which also works as an AC discharge roller to remove a charge from the conveyer belt 1. The roller 10*b* is a driven roller and also works as an electrifying roller to electrifies the conveyer belt 1. The rollers 10*c* and 10*d* are guide rollers. The roller 10*d* also works as a tension roller which provides a given degree of tension to the conveyer belt 1.

A hopper 70 is disposed beneath the conveyer belt 1 which stores therein a stack of print sheets P. A pickup roller 72 picks up one of the print sheets P from the hopper 70 and carries it to the conveyer belt 1 through a pair of paper feed rollers 74. The print sheet P is transported by the conveyer belt 1 to the print assemblies 68Y, 68M, 68C, and 68K in which full color images are printed. After printing, the print sheet P is fed to a fixing device 76 and ejected through a guide roller (not shown) installed on an end cover 66 toward a stacker provided on an upper surface of a top cover 64.

The conveyer belt 1 is charged by the driven roller 10*b* to hold thereon the print sheet P when it reaches the conveyer belt 1 through the driven roller 10*b*. The print sheet P is, thus, moved to a printing station in a given positional relation to the conveyer belt 1. The driven roller 10*a*, as described above, works as the discharge roller which removes charges from the conveyer belt 1, thereby causing the print sheet P to be separated from the conveyer belt 1 when it reaches the driven roller 10*a*. The print sheet P is next carried to the fixing device 76.

The print assemblies 68Y, 68M, 68C, and 68K are identical in structure. The primary distinction between them is the color of toner particles contained therein. Specifically, the print assembly 68Y stores therein developer containing yellow toner particles to form a yellow toner image on the print sheet P transported by the conveyer belt 1. The print assembly 68M stores therein developer containing magenta toner particles to form a magenta toner image on the print sheet P transported by the conveyer belt 1. The print assembly 68C stores therein developer containing cyan toner particles to form a cyan toner image on the print sheet P transported by the conveyer belt 1.

When the print sheet P enters, as shown in FIG. 1, the print station at the driven roller 10*b* and passes through the print assemblies 68Y, 68M, 68C, and 68K, yellow, magenta, cyan, and black toner images are overlaid to form a full color image on the print sheet P. The print sheet P is next transported from the driven roller 10*a* to the heat roller type fixing device 76 in which the full color image is thermally fixed on the print sheet P.

Each of the print assemblies 68Y, 68M, 68C, and 68K is designed as an image-transferring unit which includes a photosensitive drum 78, a charging roller (not shown), a developing device (not shown), and a toner cleaner (not shown). Each image-forming unit is installed detachably on a frame 62.

The conventional tandem color printers wherein a print sheet is transported by a conveyer belt to a print station in which a plurality of image transfer units are placed in line have problems in that a belt drive shaft of a driven roller for a fixing device is heated by radiation of heat from the fixing device located near the belt drive shaft, leading to a local rise in temperature of the conveyer belt, and the conveyer belt is cooled as moving away from the belt drive shaft, which results in a considerable change in temperature of the conveyer belt, thereby causing the speed of the conveyer belt to be changed. The change in speed of the conveyer belt will cause the timing where each of Y, M, C, and K toner images is transferred to the print sheet to be shifted from the timing where the print sheet passes a corresponding one of the image transfer units, thereby resulting in a shift between colors.

Specifically, the main factor of the change in speed of the conveyer belt is thermal expansion of the conveyer belt caused by transfer of the heat from the belt drive shaft.

Figure 2:
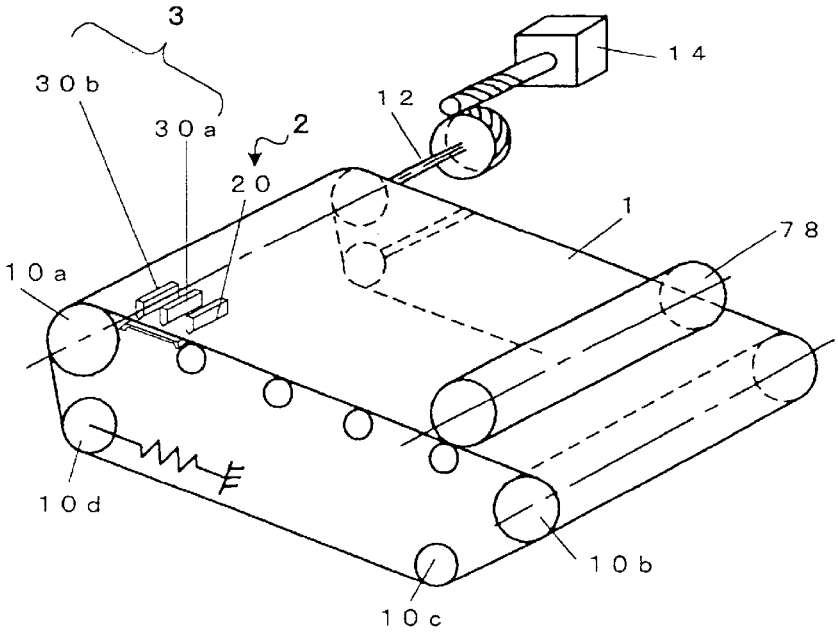
FIG. 2 is a perspective view which shows a detecting device and a mark writing device installed above a conveyer belt.
Figure 3:
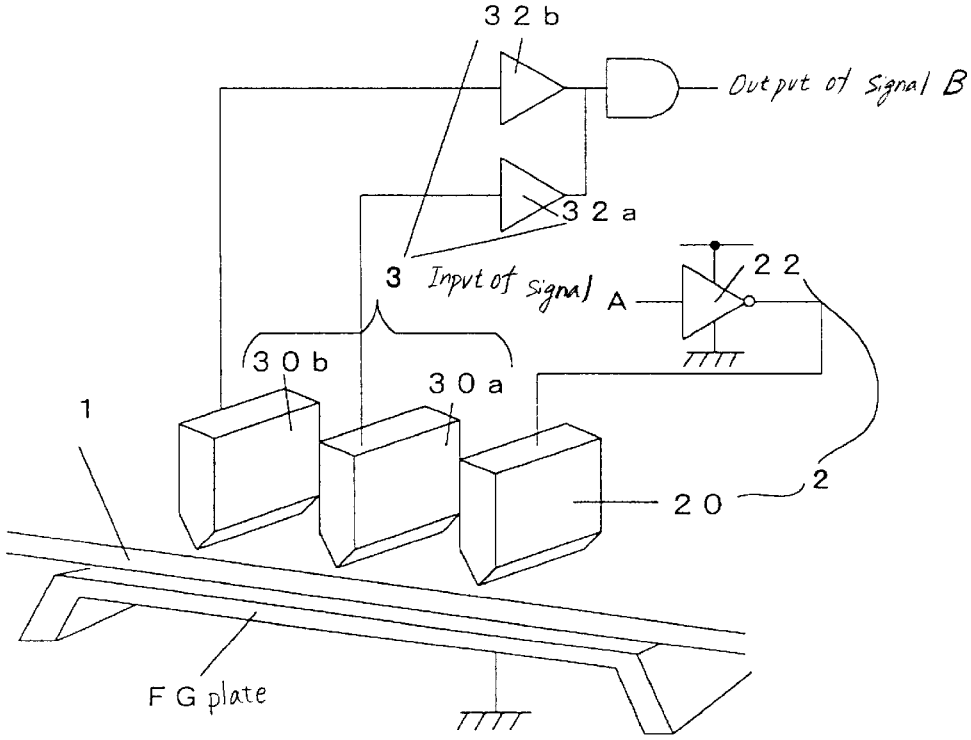
FIG. 3 is an enlarged view of the detecting device and the mark writing device in FIG. 2.

FIGS. 2 and 3 show a mark writing device 2 and a detecting device 3. The mark writing device 2 writes marks in the form of electrostatic images on the conveyer belt 1 transporting the print sheet P to which toner images are to be transferred from the print assemblies 68Y, 68M, 68C, and 68K. The detecting device 3 detects the marks written on the conveyer belt 1 and outputs a signal indicative thereof to a correction circuit 4, as will be discussed later in FIG. 4.

The conveyer belt 1 is, as described above, made of a dielectric material such as Polyvinylidene Fluoriden. The application of charges to the conveyer belt 1 through the mark writing device 2, thus, causes an electrostatic mark to be formed on a charged portion of the conveyer belt 1. The conveyer belt 1 is moved by the driven roller 10*a*. The driven roller 10*a* is supported by a shaft 12 and turned by a belt motor 14. The speed of the conveyer belt 1 is regulated by controlling the rotation of the belt motor 14.

The mark writing device 2 consists of, as shown in FIG. 2, a blade-shaped electrode 20 and a charging circuit 22. The electrode 20 is disposed above the conveyer belt upstream of the detecting device 3. The charging circuit 22 applies higher voltages to the electrode 20 cyclically in the form of pulses. Specifically, the charging circuit 22 is responsive to pulse signals A, as shown in FIG. 5, outputted at regular intervals from a sensor controller 48 of a print engine controller 40, as will be described later in FIG. 4, to apply the higher voltages to the electrode 20, forming the electrostatic marks on the conveyer belt 1.

The detecting device 3 consists of a pair of blade-shaped electrodes 30*a* and 30*b* and a pair of high impedance-operational amplifiers 32*a* and 32*b*. The electrodes 30*a* and 30*b* are disposed above the conveyer belt 1 downstream of the mark writing device 2 and connected to the operational amplifiers 32*a* and 32*b*, respectively. Under the principle of a surface potential meter, passage of the electrostatic mark beneath the electrodes 30*a* and 30*b* will cause the current to be produced in the electrodes 30*a* and 30*b* which is, in turn, amplified by the operational amplifiers 32*a* and 32*b* and outputted as a signal B to the sensor controller 48 of the print engine controller 40.

Figure 4:
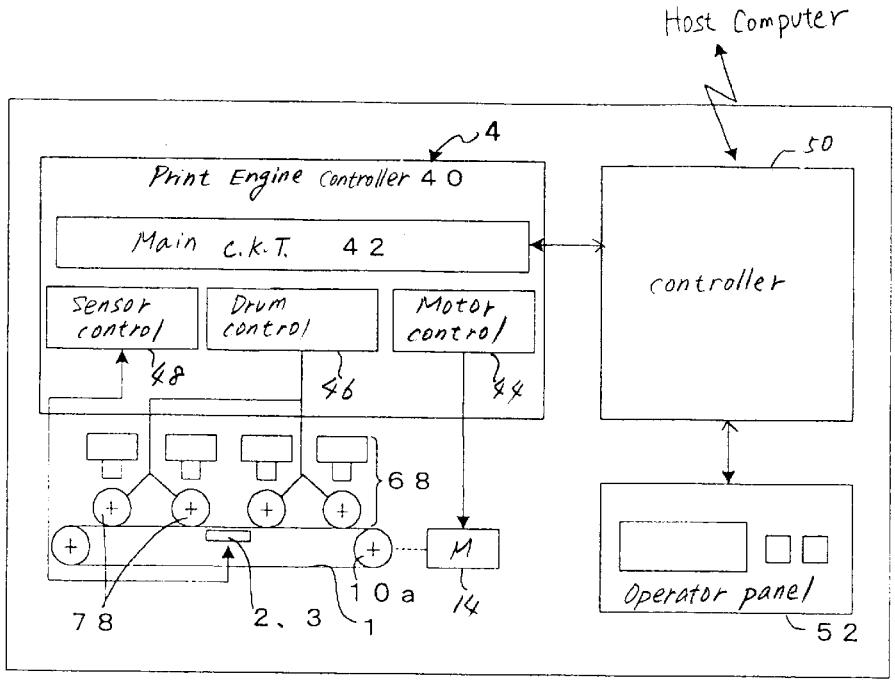
FIG. 4 is a circuit structure of an image-forming device of the first embodiment.
Figure 5:
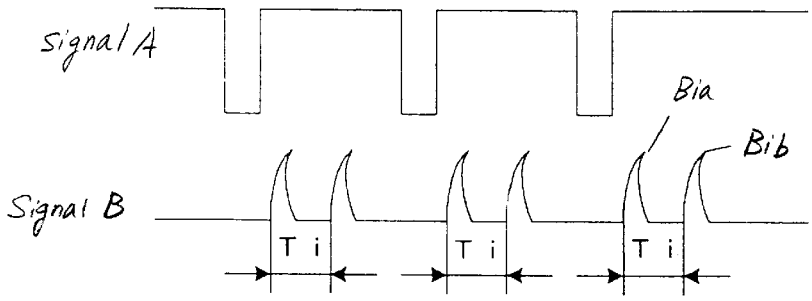
FIG. 5 is an illustration which shows waveform of a signal A inputted to a mark writing device and waveform of a signal B outputted from a detecting device.

The correction circuit 4 includes, as shown in FIG. 4, a main control circuit 42 which is the part of the print engine controller 40 and a motor controller 44. The correction circuit 4 determines the speed of the conveyer belt 1 using the signals B inputted to the sensor controller 48 from the detecting device 3 and controls the speed of the belt motor 14 to bring the speed of the conveyer belt 1 into agreement with a target one.

FIG. 4 shows a circuit structure of the image-forming device 60.

The image-forming device 60 includes a controller 50 and a print engine controller 40. The controller 50 has an operator panel 52 and communicates with a host computer to separate a color image to be printed into primary color images (i.e., toner images) and to control the whole operation of the image-forming device 60. The print engine controller 40 controls mechanisms of the image-forming device 60 and includes the main control circuit 42. The main control circuit 42 forms the part of the correction circuit 4 which measures and controls the speed of the conveyer belt 1. The print engine controller 40 also includes the motor controller 44, the photosensitive drum controller 46, and the sensor controller 48. The motor controller 44 operates the belt motor 14 and regulates the speed thereof. The photosensitive drum controller 46 controls the speed of the photosensitive drum 78 of each of the print assemblies 68Y, 68M, 68C, and 68K. The sensor controller 48 outputs the signals A at regular intervals to the charging circuit 22 of the mark writing device 2 and receives the signals B outputted from the operational amplifiers 32*a* and 32*b* of the detecting device 3.

FIG. 5 shows waveforms of the signal A inputted to the charging circuit 22 of the mark writing device 2 from the sensor controller 48 and the signal B outputted from the operational amplifiers 32*a* and 32*b* . Upon passage of the electrostatic mark formed on the conveyer belt 1, the electrode 30*a* of the detecting device 3 first produces a current signal Bia, after which the electrode 30*b* produces a current signal Bib at a time interval Ti away from the current signal Bia. In FIG. 5, each time interval Ti is defined between rising edges of the current signals Bia and Bib. The correction circuit 4 measures the time interval Ti in response to inputs of the current signals Bia and Bib and determines the speed S1 of the conveyer belt 1 based on a relation of S1=L1/Ti where L1 is a preselected distance between the electrodes 30*a* and 30*b*. Subsequently, the correction circuit 4 compares the speed S1 and a nominal speed S to determine a difference therebetween and controls the frequency of a pulse signal inputted to the motor controller 44 so as to eliminate the speed difference. Specifically, when the time interval Ti is longer, the correction circuit 4 increases the speed of the conveyer belt 1, while when the time interval Ti is shorter, the correction circuit 4 decreases the speed of the conveyer belt 1.

Figure 6:
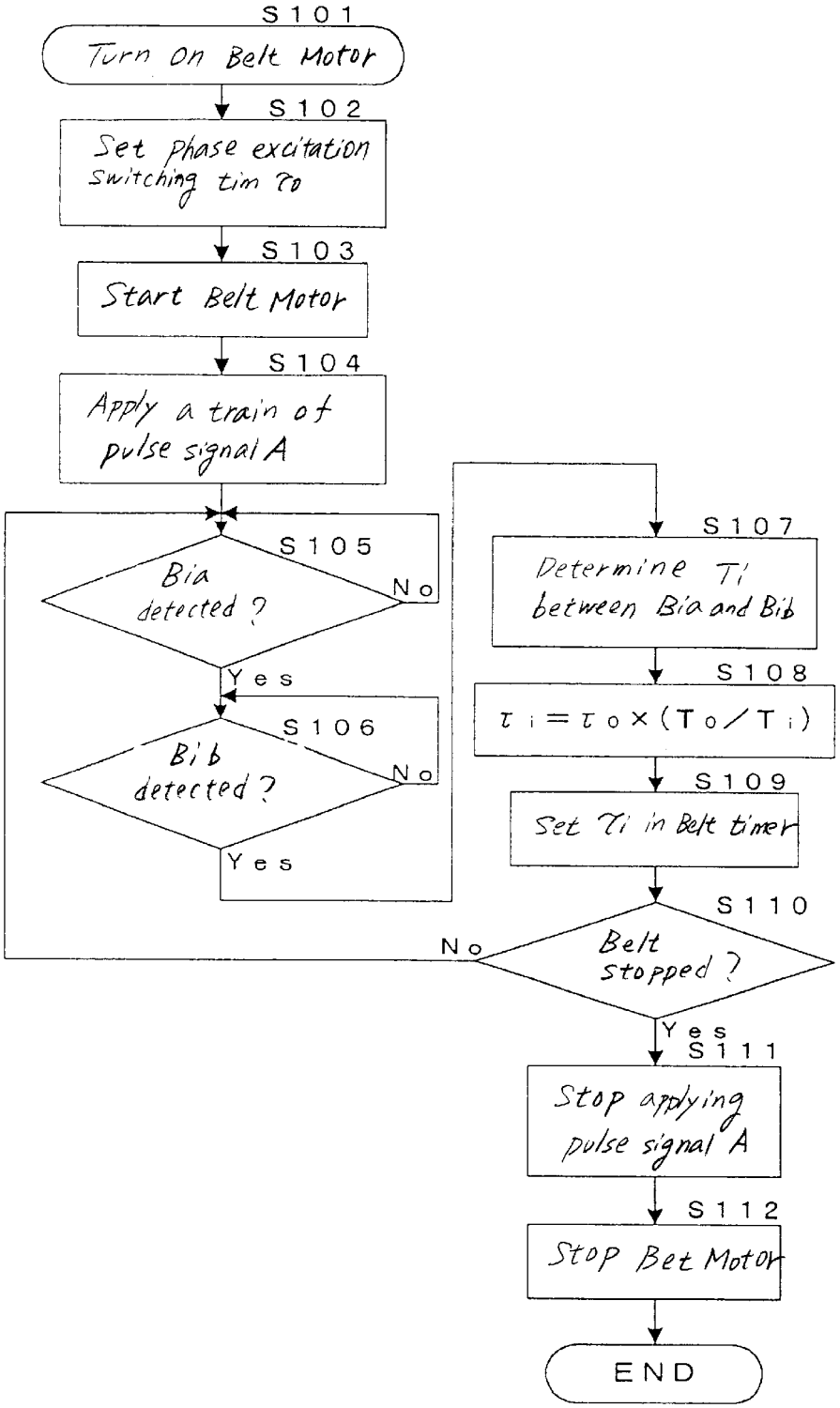
FIG. 6 is a flowchart of a program performed to correct the speed of a conveyer belt.

FIG. 6 is a flowchart of a program or sequence of logical steps performed by the image-forming device 60.

Upon input of a print request signal after the image-forming device 60 is turned on, and a given printer initializing operation is completed, the routine proceeds to step 101 wherein the belt motor 14 is turned on. The routine proceeds to step 102 wherein a nominal phase excitation switching time $\tau_0$ is set in a belt timer built in the motor controller 44. The routine proceeds to step 103 wherein the rotation of the belt motor 14 is started.

The routine proceeds to step 104 wherein the sensor controller 48 starts to apply the pulse signals A at regular intervals to the electrode 20 of the mark writing device 2. The routine proceeds to step 105 wherein it is determined whether a rising edge of the current signal Bia outputted from the electrode 30*a* of the detecting device 3 is detected or not. If a NO answer is obtained, then the routine repeats step 105. Alternatively, if a YES answer is obtained, then the routine proceeds to step 106 wherein a rising edge of the current signal Bib outputted from the electrode 30*b* of the detecting device 3 is detected or not. If a NO answer is obtained, then the routine repeats step 106. Alternatively, if a YES answer is obtained, then the routine proceeds to step 107 wherein the time interval Ti between the rising edges of the current signals Bia and Bib is determined. The routine proceeds to step 108 wherein a nominal phase excitation switching time $\tau_1$ is determined using an equation of $\tau_1=\tau_0\times$ ($T_0/T_I$) where $T_I$ is a minimal value of a time interval between the current signals Bia and Bib.

The routine proceeds to step 109 wherein the nominal phase excitation switching time $\tau_1$ is set in the belt timer to control the frequency of pulse signals inputted to the motor controller 44, bringing the speed of the conveyer belt 1 into agreement with the nominal speed (i.e., a target speed). The routine proceeds to step 110 wherein it is determined whether the conveyer belt 1 is stopped or not. If a NO answer is obtained, then the routine returns back to step 105. Alternatively, if a YES answer is obtained, then the routine proceeds to step 111 wherein the application of the pulse signals A to the electrode 20 of the mark writing device 2 is stopped. The routine proceeds to step 112 wherein the belt motor 14 is turn, off.

The image-forming device 60 also measures the speed of the photosensitive drum 78 of each of the print assemblies 68Y, 68M, 68C, and 68K in the same manner as described above and brings it into agreement with a target one.

Figure 7:
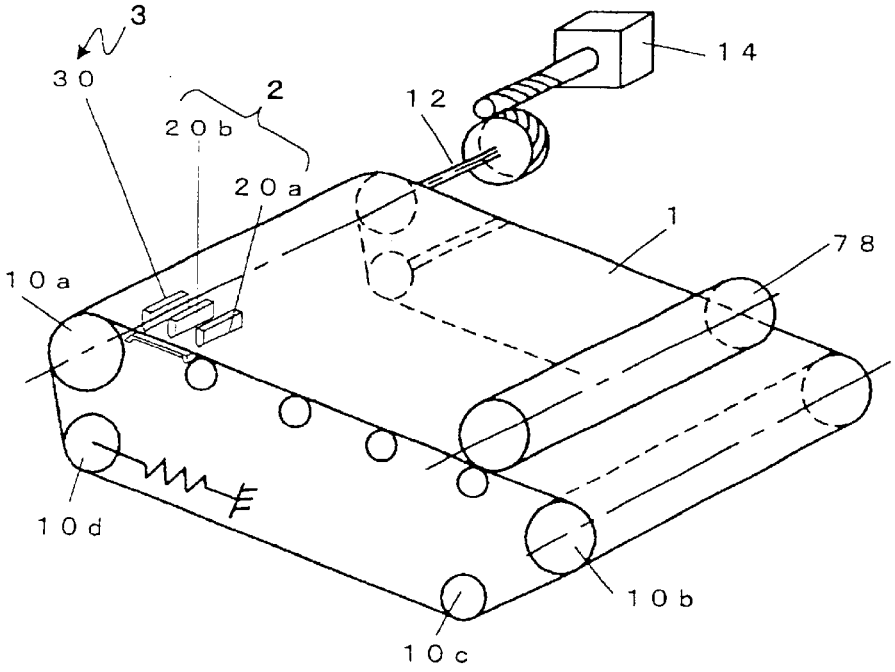
FIG. 7 is a perspective view which shows a detecting device and a mark writing device installed above a conveyer belt according to the second embodiment of the invention.

FIG. 7 shows the second embodiment of the invention.

Figure 8:
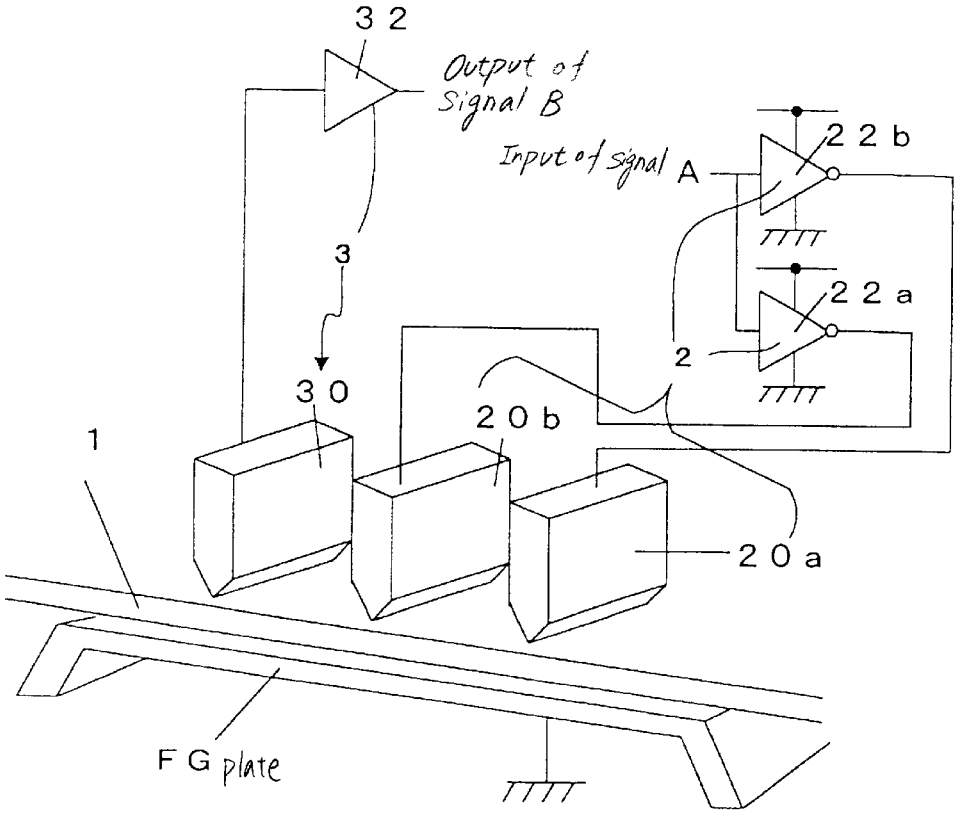
FIG. 8 is an enlarged view of the detecting device and the mark writing device in FIG. 7.

The mark writing device 2 consists of a pair of blade-shaped electrodes 20*a* and 20*b* and charging circuits 22*a* and 22*b,* as shown in FIG. 8. The electrodes 20*a* and 20*b* are disposed above the conveyer belt upstream of the detecting device 3. The charging circuits 22*a* and 22*b* apply higher voltages to the electrodes 20*a* and 20*b* cyclically in the form of pulses. Specifically, each of the charging circuits 22*a* and 22*b* is responsive to the pulse signals A, as shown in FIG. 5, outputted at regular intervals from the sensor controller 48 of the print engine controller 40 to apply the higher voltages to one of the electrodes 20*a* and 20*b,* forming the electrostatic marks on the conveyer belt 1.

The detecting device 3 consists of a single blade-shaped electrode 30 and a high impedance-operational amplifier 32, as shown in FIG. 8. The electrode 30 is disposed above the conveyer belt 1 downstream of the mark writing device 2 and connected to the operational amplifier 32. The passage of each electrostatic mark beneath the electrode 30 will cause the current to be produced which is, in turn, amplified by the operational amplifier 32 and outputted as the signal B to the sensor controller 48 of the print engine controller 40. The sensor controller 48 detects rising edges of two consecutive signals B, that is, the current signals Bia and Bib produced by two consecutive marks formed on the conveyer belt 1 by the electrodes 20*a* and 20*b* to determine, like the first embodiment, the time interval Ti between the current signals Bia and Bib.

The correction circuit 4 measures the time interval Ti in response to inputs of the current signals Bia and Bib and determines the speed S2 of the conveyer belt 1 based on a relation of S2=L2/Ti where L1 is a preselected distance between the electrodes 20*a* and 20*b* of the mark writing device 2. Subsequently, the correction circuit 4 compares the speed S2 and the nominal speed S to determine a difference therebetween and controls the frequency of a pulse signal inputted to the motor controller 44 so as to eliminate the speed difference.

Other arrangements and operations are identical with those of the first embodiment, and explanation thereof in detail will be omitted here.

FIG. 9 shows the mark writing device 2 according to the third embodiment of the invention which is different from the one shown in FIGS. 7 and 8 in that electrostatic marks are formed on the conveyer belt 1 at a given time interval therebetween Other arrangements are identical, and explanation thereof in detail will be omitted here.

The charging circuits 22*a* and 22*b* are responsive to the pulse signals A1 and A2 outputted from the sensor controller 48 of the print engine controller 40 to apply the higher voltages to the electrodes 20*a* and 20*b,* respectively. Specifically, a train of the pulse signals A1, as shown in FIG. 10(*a*), are inputted to the electrode 20*a* to form first electrostatic marks on the conveyer belt 1, while a train of the pulse signals A2 are inputted to the electrode 20*b* at a preselected time interval away from the train of the pulse signals A1 to form second electrostatic marks on the conveyer belt 1. The time interval between the pulse signals A1 and the pulse signals A2 is so determined that a first one of the second electrostatic marks is formed in registration with a first one of the first electrostatic marks.

The waveforms of the signals B produced by the electrode 30 of the detecting device 3 are shown in FIG. 10(*b*). In FIG. 10(*b*), a first one of the second electrostatic marks is in registration with a first one of the first electrostatic marks. In this case, the signals B produced by the first and second electrostatic marks overlap with each other to have a waveform as shown on the leftmost side of the FIG. 10(*b*). The central waveform in FIG. 10(*b*) is produced when a shift in registration between the first and second electrostatic marks becomes the greatest. The rightmost waveform is produced when the first and second electrostatic marks are formed in registration. Specifically, this embodiment measures a phase shift between the signals B through the Fourier transform to determine a difference between an actual speed of the conveyer belt 1 and a nominal speed thereof. This difference may alternatively be determined based on a shift between the centers of the signals B.

Figure 11:
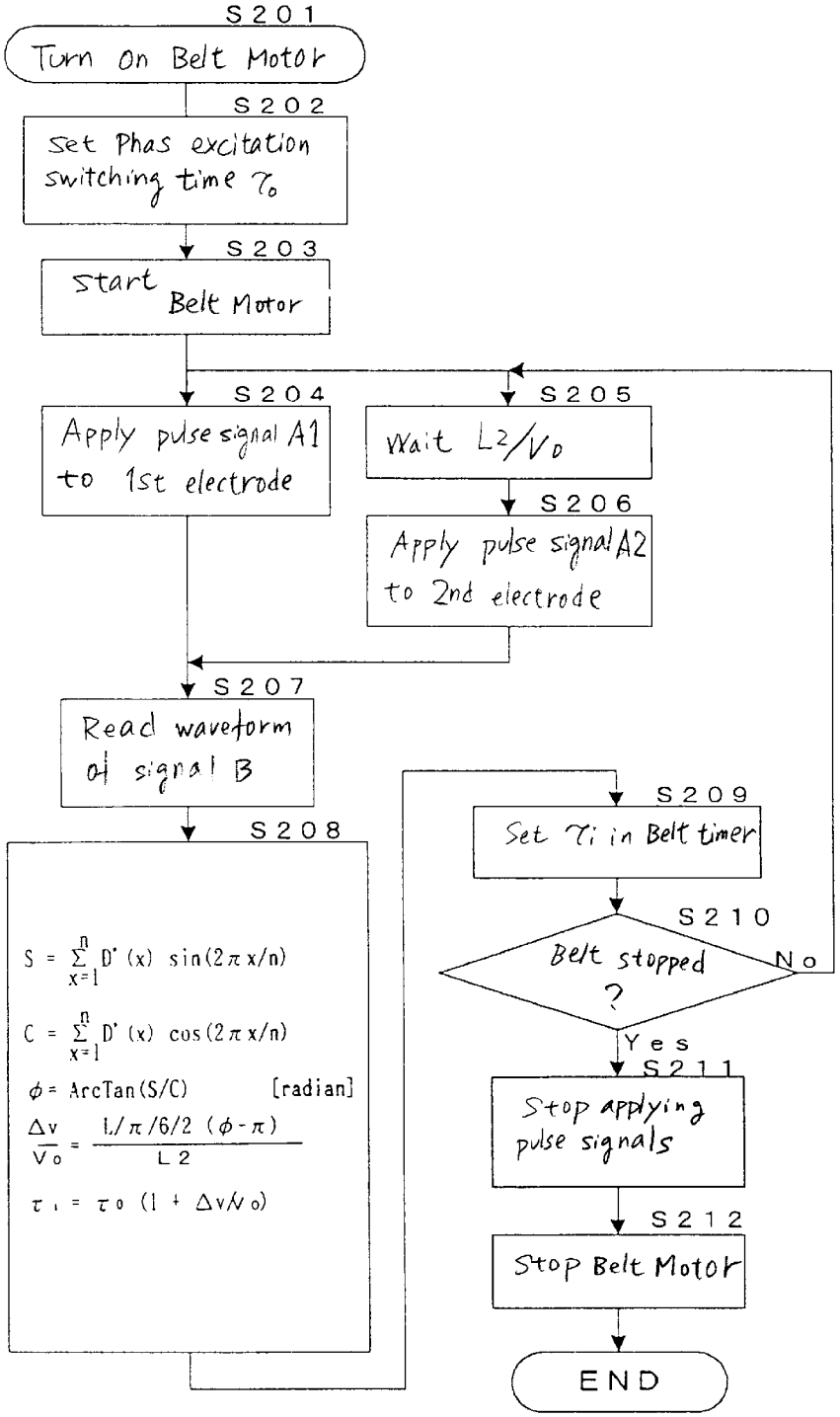
FIG. 11 is a flowchart of a program performed by an image-forming device of the third embodiment.

FIG. 11 is a flowchart of a program performed by the image-forming device 60 of the third embodiment.

Upon input of a print request signal after the image-forming device 60 is turned on, and a given printer initializing operation is completed, the routine proceeds to step 201 wherein the belt motor 14 is turned on. The routine proceeds to step 202 wherein a nominal phase excitation switching time $\tau_0$ is set in the belt timer built in the motor controller 44. The routine proceeds to step 203 wherein the rotation of the belt motor 14 is started.

The routine proceeds to step 204 wherein the sensor controller 48 starts to apply a train of the pulse signals A1 to the electrode 20*a* of the mark writing device 2. Simultaneously, the routine proceeds to step 205 and waits a preselected time of $L2/V_0$ where L2 is the distance between the electrodes 20*a* and 20*b,* and $V_0$ is the speed of the conveyer belt 1. The routine proceeds to step 206 wherein a train of the pulse signals A2 to the electrode 20*b* of the mark writing device 2.

After steps 204 and 206, the routine proceeds to step 207 wherein the detecting device 3 picks up the current signal B through the electrode 30. The routine proceeds to step 208 wherein a speed difference is determined using the Fourier transform, and the nominal phase excitation switching time $\tau_i$ is determined in a manner as described below.

Assuming a sensor output waveform D(t) is sampled from time t1 to time t2 in a cycle Ts, following conversions are performed.

$$t=t1\rightarrow x=0$$

$$t=t2\rightarrow x=(t2-t1)/Ts-n$$

$$D(t)\rightarrow d'(x)$$

If a component to be added to a sine wave is defined as S, and a component to be added to a cosine wave is defined as C, we obtain $$S = \sum_{X=1}^{n} D'(x)\sin(2\pi x/n)$$

$$C = \sum_{X=1}^{n} D'(x)\cos(2\pi x/n)$$

Thus, from the cosine wave, the phase difference may be determined as $\phi$=ArcTan(S/C)[radian].

Next, using the thus determined phase difference $\phi$, the speed deviation $\Delta v/V_0$ is determined. The cycle of the pulse signals A1 is so set that the center-to-center distance L between the mark No. 1 and the mark No. 6, as shown in FIG. 10(*a*), produced by the pulse signals A1 is equal to the center-to-center distance between the mark No. 1 and the mark No. 7 produced by the pulse signals A2. If a phase difference between the pulse signals A1 and A2 is zero (0), the mark No. 4 produced by one of the pulse signals A2 appears at an intermediate location between the marks No. 3 and No. 4 produced by the pulse signals A1. Specifically, the mark No. 4 produced by the pulse signal A2 is shifted from the marks No. 3 and No. 4 produced by the pulse signals A1, so that the signal B shows the waveform closest to a −cosine wave. Alternatively, if the mark No. 4 produced by the pulse signal A2 is in registration with the mark No. produced by the pulse signal A1, the signal B shows the waveform close to a cosine wave.

Comparing between the former and the latter case, it is found that the movement of the mark produced by the pulse signal A2 by a distance (=L/6/2) of half a distance (=L/6) between the marks No. 3 and No. 4 produced by the pulse signals A1 causes the signal B to have ±cosine waveform components, resulting in a phase shift of 180°=$\pi$[rad]. Thus, a relation between the phase shift and a shift in registration between the marks is expressed by $\delta=L/6/2/\pi(\phi-\pi)$. Since when the shift in registration between the marks is zero (0), the signal B has, as described above, −cosine waveform, the term $(\phi-\pi)$ is provided for conversion of the phase difference derived based on the cosine waveform.

The shift in registration between the marks occurs during movement of the conveyer belt 1 by the distance L2. The speed deviation may, thus, be expressed by $\Delta v/V_0=L/6/2/\pi(\phi-\pi)/L2$. After the speed deviation is calculated using this equation, the nominal phase excitation switching time $\tau_i$ is determined using the relation of $\tau_i=\tau_0\times(1+\Delta v/V_0)$ After step 208, the routine proceeds to step 209 wherein the nominal phase excitation switching time $\tau_1$ is set in the belt timer to control the frequency of pulse signals inputted to the motor controller 44, bringing the speed of the conveyer belt 1 into agreement with the nominal speed (i.e., a target speed). The routine proceeds to step 210 wherein it is determined whether the conveyer belt 1 has been stopped or not. If a NO answer is obtained, then the routine returns back to steps 205 and 204. Alternatively, if a YES answer is obtained, then the routine proceeds to step 211 wherein the application of the pulse signals A1 and A2 to the electrodes 20*a* and 20*b* of the mark writing device 2 is stopped. The routine proceeds to step 212 wherein the belt motor 14 is turned off.

The image-forming device 60 also measures the speed of the photosensitive drum 78 of each of the print assemblies 68Y, 68M, 68C, and 68K in the same manner as described above and brings it into agreement with a target one.

Figure 12:
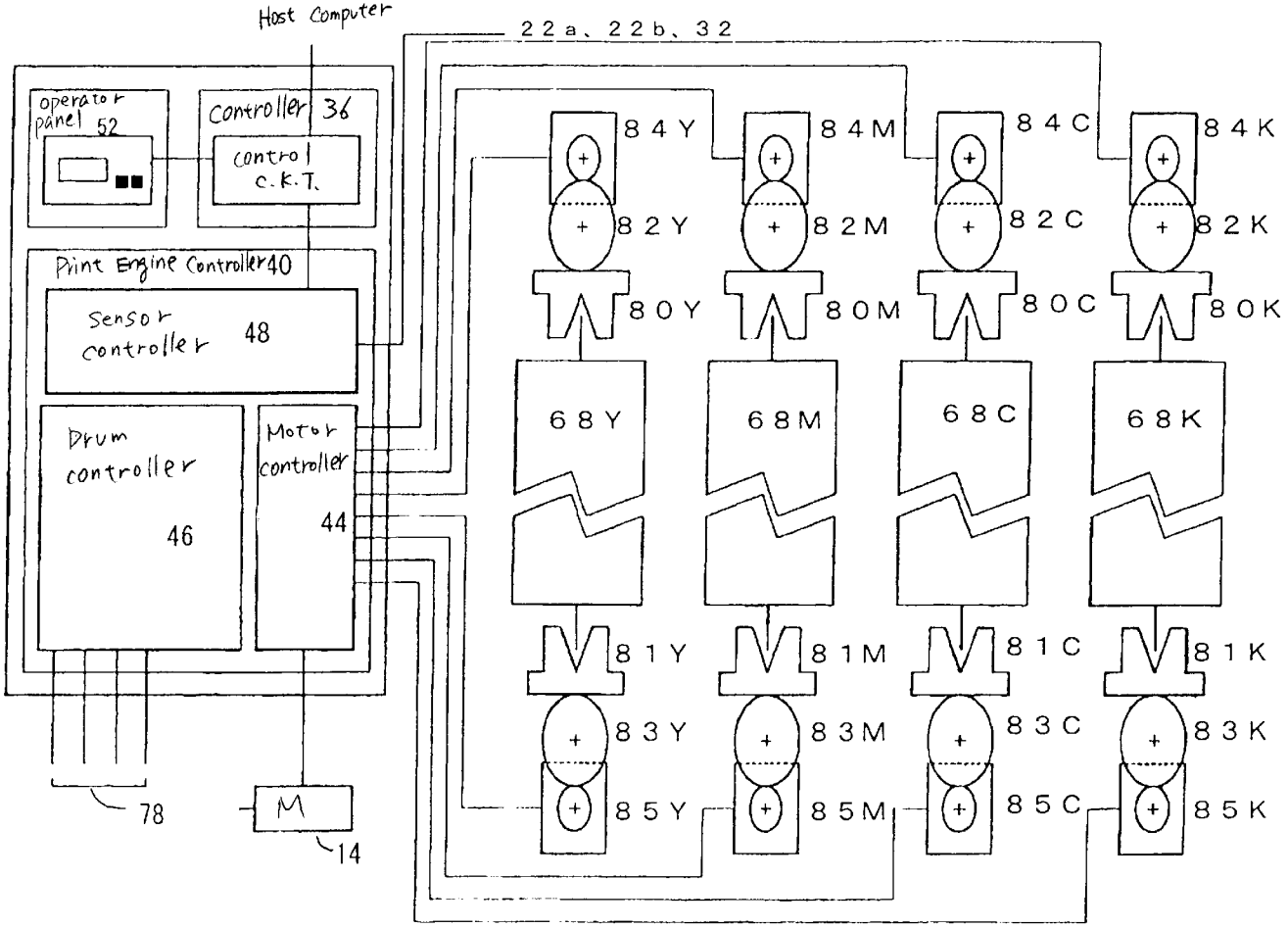
FIG. 12 is a block diagram which shows an image-forming device according to the fourth embodiment of the invention.

FIG. 12 shows an image-forming device according to the fourth embodiment of the invention which is different from the first embodiment in that the position of each of the print assemblies 68Y to 68K) is changed to correct a location where each toner image is transferred onto the print sheet P carried by the conveyer belt 1. The same reference numbers as employed in the first embodiments refer to the same parts, and explanation thereof in detail will be omitted here.

The print assemblies 68Y, 68M, 68C, and 68K are supported by the positioning members 80Y, 81Y, 80M, 80M1, 80C, 81C, 80K, and 81K. The positioning members 80Y, 81Y, 80M, 81M, 80C, 81C, 80K, and 81K are installed on a device casing (not shown) so as to be movable only in a lateral direction, as viewed in the drawing. Portions of the positioning members 80Y to 81K opposite portions thereof supporting the print assemblies 68Y to 68K are provided with gears connected mechanically to print assembly drive motors 84Y, 85Y, 84M, 85M, 84C, 85C, 84K, and 85K through intermediate gears 82Y, 83Y, 82M, 83M, 82C, 83C, 82K, and 83K.

In operation, when the print assembly drive motor 84Y is rotated in a counterclockwise direction, as viewed in the drawing, and the print assembly drive motor 85Y is rotated in a clockwise direction through the same angular steps as those of the print assembly drive motor 84Y, the positioning members 80Y and 81Y are moved in parallel in the left direction to shift the print assembly 68Y away from the print assemblies 68M, 68C, and 68K. In other words, intervals between the print assembly 68Y and the other three print assemblies 68M, 68C, and 68K are increased, respectively. Conversely, when the print assembly drive motor 84Y is rotated in the clockwise direction, and the print assembly drive motor 85Y is rotated in the counterclockwise direction, the positioning members 80Y and 81Y are moved in parallel in the right direction to shorten the intervals between the print assembly 68Y and the other three print assemblies 68M, 68C, and 68K.

Figure 13:
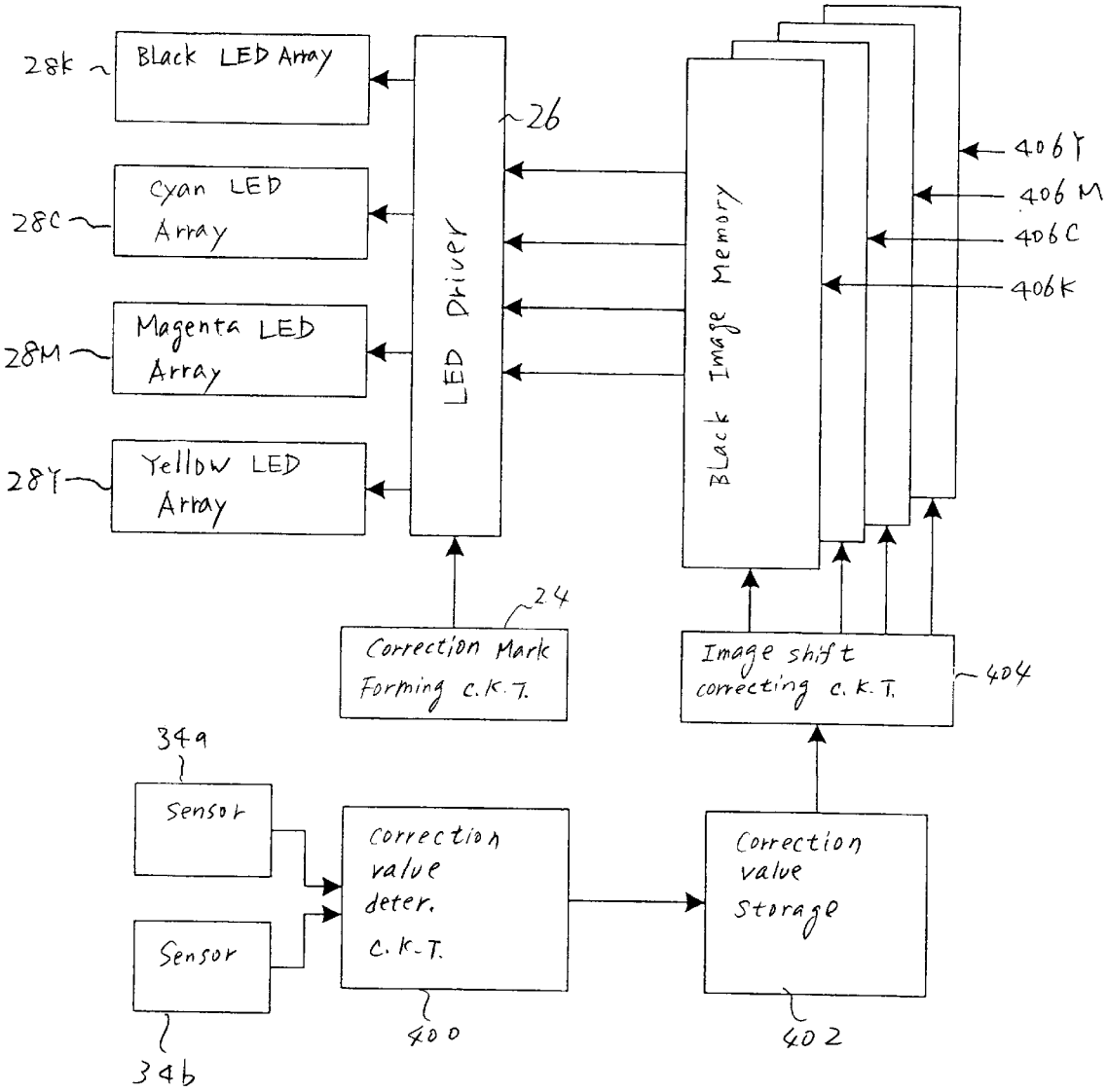
FIG. 13 is a block diagram which shows a circuit structure designed to determine a correction value for correcting a locational shift of each print assembly.
Figure 14A:
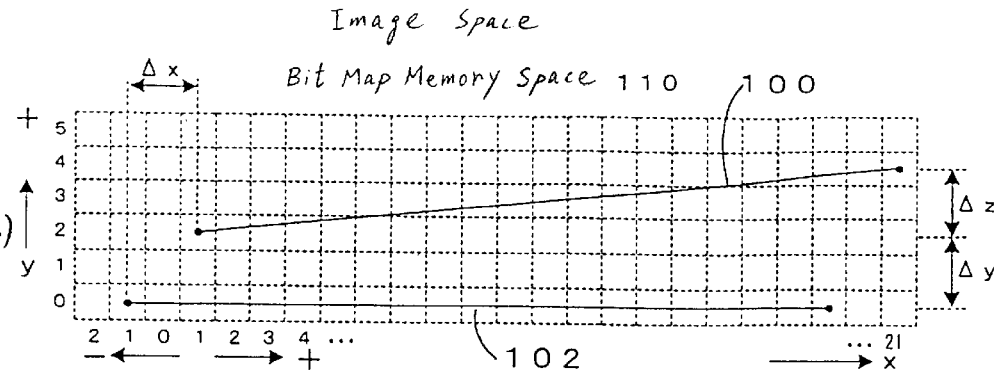
FIG. 14(*a*) shows a bit map memory space.
Figure 14B:
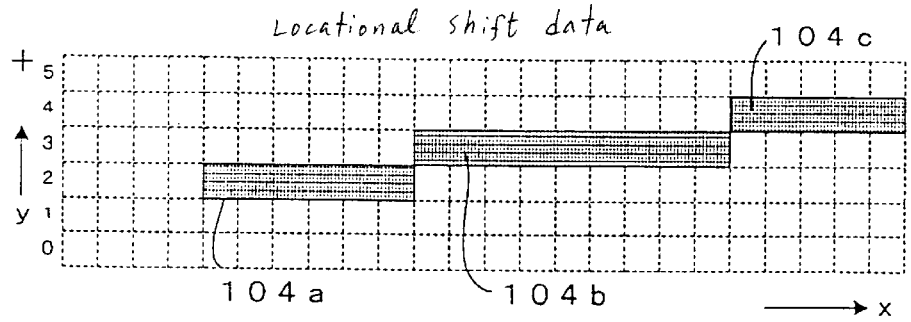
Figure 14C:
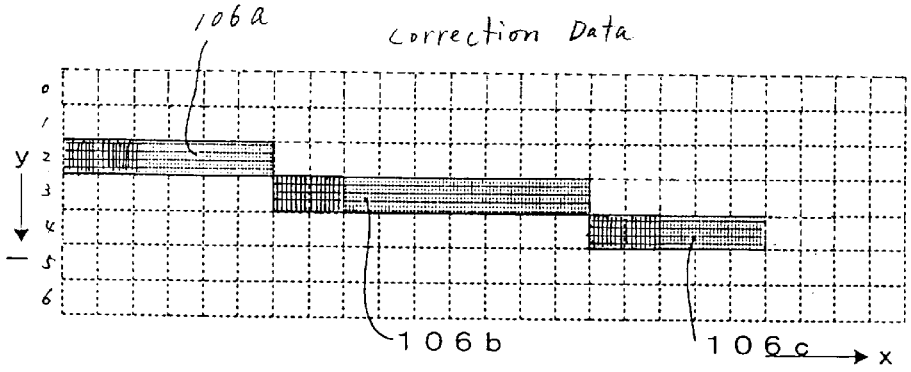
Figure 14D:
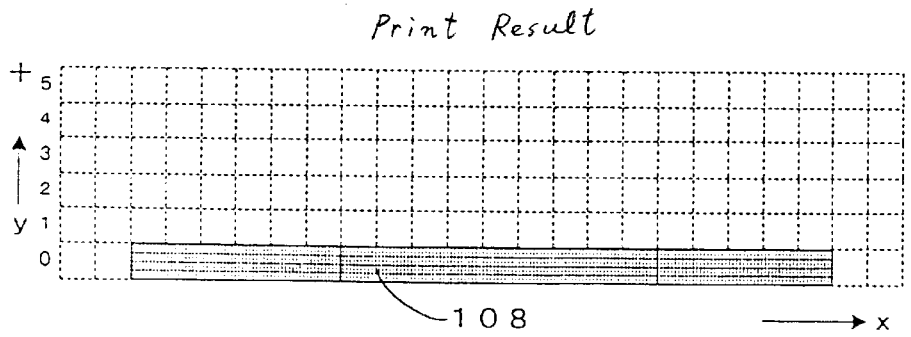

The image-forming device of this embodiments has a circuit structure, as shown in FIG. 13, which is designed to determine a correction value for correcting a locational shift of each of the print assemblies 68Y to 68K. The image-forming device includes a correction mark forming circuit 24, a correction value determining circuit 400, a correction value storage 402, and an image shift correcting circuit 404. The functions of these circuits are realized by a sensor processing MPU (not shown) installed in the print engine controller 40 and an MPU (not shown) installed in controller 50.

For determining a correction value used in correcting an image shift, the correction mark forming circuit 24 forms two series of color-mixed marks on the conveyer belt 1 using a yellow LED array 28Y, a magenta LED array 28M, cyan LED array 28C, and a black LED array 28K which are activated by an LED driver 26. The series of color-mixed marks are transferred, respectively, to lateral ends of the conveyer belt which correspond to a start and an end portion of a main scanning line extending perpendicular to a traveling direction of the conveyer belt. Two sensors 34*a* and 34*b* are disposed near the conveyer belt to detect the series of color-mixed marks, respectively, and output signals indicative thereof to the correction value determining circuit 400. The image shift correction in this embodiment is achieved by determining correction values for correcting image shifts of yellow (Y), magenta (M), and cyan (C) images from a black (B) image which presents the strongest contrast to the other Y, M, and C images.

Specifically, the correction mark forming circuit 24 stores therein print information for the series of color-mixed marks having patterns, as will be described later, and activates the four LED arrays 28Y, 28M, 28C, and 28K in parallel to transfer or form on the conveyer belt a K/C mixed mark, a K/M mixed mark, and a K/Y mixed mark each of which is made up of two different color electrostatic images overlaid with a slight shift. The print information may be formed by bit-mapped patterns or alternatively be prepared as vector information. In case of the vector information, the LED driver 26 expands it to produce bit-mapped data for writing the color-mixed marks.

The correction value determining circuit 400 reads outputs of the sensors 34*a* and 34*b* and determines the phase of a brightness pattern of each series of the K/C mixed mark, the K/M mixed mark, and the K/Y mixed mark to calculate correction values for correcting image shifts of the C image, the M image, and the Y image from the K images in the K/C mixed mark, the K/M mixed mark, and the K/Y mixed mark, respectively. Specifically, the correction value determining circuit 400 determines a first correction value ΔX corresponding to a shift of each of the C image, the M image, and the Y image from the K image in a direction of the main scanning line, a second correction value ΔY corresponding to a shift of each of the C image, the M image, and the Y image from the K image in a direction of a sub-scanning line, and a third correction value ΔZ (skew correction value) corresponding to a shift of each of the C image, the M image, and the Y image from the K image in an oblique direction.

In order to increase the accuracy of calculating the first, second, third correction values ΔX, ΔY, and ΔZ based on the brightness patterns of the K/C mixed mark, the K/M mixed mark, and the K/Y mixed mark detected by the sensors 34*a* and 34*b,* the correction value determining circuit 400 performs a Fourier transform and derives Fourier coefficients a and b to determine the phase ϕ for determining the correction values ΔX, ΔY, and ΔZ.

The correction values derived in the correction value determining circuit 400 are listed in a cyan table, a magenta table, and a yellow table stored in the correction value storage 402.

The image shift correcting circuit 404 performs an address conversion for image shift correction using the correction values stored in the correction value storage 402 when image data in image memories 406Y, 406M, 406C, and 406K are expanded.

FIGS. 14(*a*) to 14(*d*) show the principle of the image shift correction based on the first, second, and third correction values ΔX, ΔY, and ΔZ derived in the correction value determining circuit 400.

A detected locational shift of a correction target print line 100 is converted into a locational shift in a bit map memory space 110, as shown in FIG. 14(*a*), defined by a pixel matrix made up of a horizontal array of pixels extending in the main scanning direction x and a vertical array of pixels extending in the sub-scanning direction y. In the shown case, an optimum print line 102 is already known, and the correction target print line 100 is defined in relation to the optimum print line 102. Specifically, using the first, second, and third correction values ΔX, ΔY, and ΔZ, the correction target print line 100 is defined in the bit map memory space 110 and converted into image data to produce, as shown in FIG. 14(*b*), locational shift data 104*a,* 104*b,* and 104*c*. Next, correction data 106*a,* 106*b,* and 106*c,* as shown in FIG. 14(*c*), are determined. The correction data 106*a* to 106*c* are equivalent to the locational shift data 104*a,* 104*b,* and 104*c,* that is, the correction target print line 100 which is reversed in a minus direction to be symmetrical with respect to the optimum print line 102 and shifted to the minus direction of the main scanning (i.e., the left direction as viewed in the drawings) by the first correction value ΔX.

Using the thus determined correction data 106*a* to 106*c,* the image shift correcting circuit 404 activates the LED array 20Y, 28M, 28C, and 28K to form an image shift-corrected print line 108, as shown in FIG. 14(*d*), which matches up with the optimum print line 102.

In this embodiment, a pitch P1 of the K images of the K/C mixed mark, the K/M mixed mark, and the K/Y mixed mark arrayed on the conveyer belt is different from a pitch P2 of other arrayed images, e.g., the C images arrayed in a lengthwise direction of the conveyer belt so that the brightness pattern of an array of the marks may show a sine wave when the shift in registration between the marks is zero, but the present invention is not limited to the same. The marks may be arrayed in any form as long as a train of the pulse signals A2, as shown in FIG. 10(*a*), is shifted from a train of the pulse signals A1, and a brightness pattern is derived which has a single maximum or minimum value as a singular point for detecting a phase conversion in a range of the leading and trailing marks defined by ±π, as determined in step 208 of FIG. 11.

For example, pitches of the K images and C images may be determined at random or as a function of a brightness pattern which has a minimum or maximum value in a range of ±π.

The above embodiment improves the accuracy of calculating the correction values by determining the phase ϕ using the discrete Fourier transform based on the fact that a brightness pattern of a two-color mixed image represents a sine curve, but may determine each image shift based on the level of a brightness pattern of scattered light based on the fact that the image shift can be determined by identifying the mark corresponding to a minimum value Lmin in the brightness pattern defined by levels of scattered light.

The image-forming device of this embodiment determines an actual speed of the conveyer belt 1 in the same manner as in the first embodiment and changes the locations of the print assemblies 68Y, 68M, 68C, and 68K through the positioning members 80Y, 81Y, 80M, 81M, 80C, 81C, 80K, and 81K to control the time the print sheet P passes each of the print assemblies 68Y to 68K, thereby correcting the locations of the images to be transferred to the print sheet P on the conveyer belt to eliminate a shift between colors.

The K images of the K/C mixed mark, the K/M mixed mark, and the K/Y mixed mark may also be formed on each of the photosensitive drums 78 to control the speed thereof for minimizing the image shifts.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, the electrodes 20, 20*a,* 20*b,* 22, 22*a,* 22*b,* 30, 30*a,* and 30*b* are disposed above an upper surface of the conveyer belt 1 in the above embodiments, but may alternatively be installed beneath a back surface of the conveyer belt 1, thereby keeping fee from foreign substances such as toner or paper powders to the electrodes. Two detecting devices 3 may be installed one on each side of the conveyer belt 1. In this case, the accuracy of detecting the marks printed on the conveyer belt 1 is improved by using an average value of the current signals B outputted from the two detecting devices 3.

The present invention is not limited to the speed correction of the conveyer belt 1 and the photosensitive drums 78 only. For example, it is possible to correct the speed of an intermediate transfer belt to which color images formed by the photosensitive drums are transferred in the same manner as described above.

What is claimed is:

1. An image-forming apparatus comprising:

an image carrier carrying images printed on one of a surface of said image carrier and a surface of a printing medium held on said image carrier, said image carrier having at least the surface made of a dielectric material;

an electrostatic mark writing device writing electrostatic marks at predetermined intervals on said image carrier during movement of said image carrier;

a detecting device detecting the electrostatic marks written on said image carrier during the movement of said image carrier to provide signals indicative thereof; and a correction device correcting a speed of the movement of said image carrier based on the signals outputted from said detecting device.

2. An image-forming apparatus as set forth in claim 1, wherein said electrostatic mark writing device includes a plurality of electrostatic mark writing units which are arrayed in a direction of the movement of said image carrier and which form the electrostatic marks on said image carrier, respectively.

3. An image-forming apparatus as set forth in claim 2, wherein each of the electrostatic mark writing units writes a series of the electrostatic marks at regular intervals, the intervals in the electrostatic mark writing units being different from each other, and wherein said correcting device performs a correcting operation based on the degree to which the electrostatic marks written by the electrostatic mark writing units are overlaid.

4. An image-forming apparatus as set forth in claim 2, wherein the number of said plurality of electrostatic mark writing units is two with a predetermined distance therebetween, said electrostatic mark writing units writes the corresponding electrostatic marks on said image carrier simultaneously with each other, said detecting device outputs the signals upon detection of said corresponding electrostatic marks, respectively, and said correction device derives a time interval between occurrences of said signals outputted from said detecting device and further derives the speed of the movement of said image carrier based on said time interval and said predetermined distance between the electrostatic mark writing units.

5. An image-forming apparatus as set forth in claim 1, wherein said detecting device includes a plurality of detecting units which are arrayed in a direction of the movement of said image carrier and which detect the electrostatic marks, respectively.

6. The image-forming apparatus of claim 1, wherein said detecting device comprises:

a blade-shaped electrode disposed above the image carrier; and a high impedance operational amplifier connected to said blade-shaped electrode.

7. An image-forming apparatus comprising:

an image carrier carrying images printed on one of a surface of said image carrier and a surface of a printing medium held on said image carrier, said image carrier having at least the surface made of a dielectric material;

an electrostatic mark writing device writing electrostatic marks at predetermined intervals on said image carrier during movement of said image carrier;

a detecting device detecting the electrostatic marks written on said image carrier during the movement of said image carrier to provide signals indicative thereof; and a correction device correcting a location where each of the images is printed based on the signals outputted from said detecting device.

8. An image-forming apparatus as set forth in claim 7, wherein said electrostatic mark writing device includes a plurality of electrostatic mark writing units which are arrayed in a direction of the movement of said image carrier and which print the electrostatic marks on said image carrier, respectively.

9. An image-forming apparatus as set forth in claim 8, wherein each of the electrostatic mark writing units writes a series of the electrostatic marks at regular intervals, the intervals in the electrostatic mark writing units are different from each other, and wherein said correcting device performs a correcting operation based on the degree to which the electrostatic marks written by the electrostatic mark writing units are overlaid.

10. An image-forming apparatus as set forth in claim 8, wherein the number of said plurality of electrostatic mark writing units is two with a predetermined distance therebetween, said electrostatic mark writing units writes the corresponding electrostatic marks on said image carrier simultaneously with each other, said detecting device outputs the signals upon detection of said corresponding electrostatic marks, respectively, and said correction device derives a time interval between occurrences of said signals outputted from said detecting device and further derives the speed of the movement of said image carrier based on said time interval and said predetermined distance between the electrostatic mark writing units.

11. An image-forming apparatus as set forth in claim 7, wherein said detecting device includes a plurality of detecting units which are arrayed in a direction of the movement of said image carrier and which detect the electrostatic marks, respectively.

12. The image-forming apparatus of claim 7, wherein said detecting device comprises:

a blade-shaped electrode disposed above the image carrier; and a high impedance operational amplifier connected to said blade-shaped electrode.

* * * * *